US005581156A

United States Patent [19]

Roberts et al.

[11] Patent Number: 5,581,156

[45] Date of Patent: Dec. 3, 1996

[54] HF SUSTAINED, DC DISCHARGE DRIVEN NEGATIVE ION SOURCE WITH AUTOMATIC CONTROL SYSTEM

[75] Inventors: Thomas G. Roberts; Brian R. Strickland, both of Huntsville, Ala.

[73] Assignee: The United States of America as represented by the Secretary of the Army, Washington, D.C.

[21] Appl. No.: 505,717

[22] Filed: Jul. 31, 1995

[51] Int. Cl.[6] ..... H01J 7/24

[52] U.S. Cl. ..... 315/111.81; 315/111.91; 313/362.1; 250/423 F

[58] Field of Search ..... 315/111.81, 111.91, 315/111.31, 111.41, 111.61; 313/362.1, 363.1, 359.1, 360.1, 361.1; 250/423 R, 427, 423 F

[56] References Cited

U.S. PATENT DOCUMENTS 4,377,773 3/1983 Hershcovitch et al. ..... 315/111.81
4,447,732 5/1984 Leung et al. ..... 315/111.81 X
4,559,477 12/1985 Leung et al. ..... 315/111.81
5,391,962 2/1995 Roberts et al. ..... 313/362.1

*Primary Examiner*—Robert Pascal
*Assistant Examiner*—Haissa Philogene
*Attorney, Agent, or Firm*—Anthony T. Lane; Hugh P. Nicholson

[57] ABSTRACT

A negative ion source with an automatic control system wherein a low power high frequency discharge is used to sustain a high power low voltage dc discharge in a chamber that magnetically confines the plasma produced. The low power high frequency discharge and the high power low voltage direct current discharge are two discharges along with the gas flow rate which are independently adjusted, automatically, so that the conditions for optimum production of vibationally excited hydrogen molecules consistent with the production of maximum $H^-$ output current is obtained and maintained. This chamber is separated by a magnetic filter field from a second chamber which maintains the low temperature plasma in the second chamber necessary for the optimum production of $H^-$ ions by the process of dissociative attachment, utilizing the vibrationally excited molecules produced by the first chamber.

3 Claims, 5 Drawing Sheets

HF SUSTAINED, DC DISCHARGE DRIVEN NEGATIVE ION SOURCE WITH AUTOMATIC CONTROL SYSTEM

DEDICATORY CLAUSE

The invention described herein may be manufactured, used, and licensed by or for the Government for governmental purposes without the payment to us of any royalties thereon.

BACKGROUND OF THE INVENTION

To produce a negative ion source, it is necessary to first create and confine a plasma which produces positive ions, electrons, excited neutral molecules, and some negative ions. The confinement is obtained by various magnetic field configurations, usually produced by permanent magnets. The conditions in these self sustained plasmas are not optimum for producing negative ions, and their ion concentration is generally low. It is also very difficult to extract these negative ions because of the potential barrier that exists across the plasma sheath at the extraction aperture. This potential is proportional to the electron temperature in the plasma. Note here that this potential tends to pull the positive ions out of the plasma. Thus, a positive ion source is somewhat easier to build. In such a source, the positive ions just fall down the potential well and out of the plasma.

To circumvent this problem in a negative ion source, an additional magnetic field, called the filter field, is used to screen the plasma, and in particular its high energy electrons, from the region near the extraction aperture. In this manner, the negative ion source is magnetically broken into two chambers. In the first chamber, a discharge creates a plasma with a relatively high electron temperature which is necessary to sustain the discharge and to generate the vibrationally excited molecules necessary for low temperature $H^-$ production. In the second chamber, near the extraction aperture, a plasma with a very low electron temperature is produced. Even though the filter field prevents the high energy electrons from entering the second chamber, the low energy electrons cross the filter field. Some low energy electrons enter the second chamber as a result of negative ions produced in the first chamber, near the filter, crossing the filter field and then becoming neutralized in stripping collisions. This process helps to produce the low temperature ($kT_e \leqq 1$ eV) plasma found there. Another possibility is that those low energy electrons, whose relative velocity with respect to the positive ions in the plasma is low, form a quasi-bound particle that appears as a neutral entity while it crosses the magnetic field, but disassociates when it enters the second chamber, thus also helping to create the low temperature plasma in this region. In any event, the potential barrier across the plasma sheath at the extractor is now quite low due to the low electron temperature, and negative ions with energies of the order of 1 eV can escape and be extracted. Low temperature negative ions are necessary if the high brightness beams required for some applications are to be formed.

Negative ion sources have found useful applications in plasma fusion devices for diagnostic, neutral beam heating, and current drive where very high currents are required; and in high energy accelerators where low emittance beams are often necessary. More recent high-energy accelerator applications have been in the area of neutral particle beam weapon (NPB) systems. In this application, ion beams are produced, accelerated to high energies, directed towards a distant target; and are then neutralized by stripping the excess lightly bound electron. This produces a neutral particle beam which propagates to the target without being affected by the earth's magnetic field.

In order for the neutral particle beam to be of a reasonable size (about the size of the target) when it reaches the distant target, a very low emittance beam is required. Also, if the target is to be damaged, a reasonably high current is needed. These two requirements, when taken together, mean that a very high brightness beam is necessary. In this application, it is also necessary for the system to operate autonomously. Thus, a well behaved automatically controlled source is required. The ability to automatically control the source is also useful in many of the other applications.

This need for low emittance, high brightness beams places severe requirements on the accelerator, magnetic optics, neutralizer, and, in particular, on the ion source. If current is not lost in accelerating the beam, then the brightness and emittance can be no better than that produced by the ion source and, generally, the brightness will be decreased each time the beam is manipulated in any way. The emittance, $\epsilon$, at the source is given by $$\epsilon \propto r\left(\frac{kT_i}{K.E.}\right)^{1/2},$$

where r is the radius of the extraction aperture, k is Boltzmann's constant, K.E. is the kinetic energy received at extraction, and $T_i$ is the temperature of the negative ions just after extraction and acceleration to ground potential. This equation is just an expression of the Heisenberg uncertainty principle, since ($T_i$) is proportional to the random momentum of the negative ions in the beam and r is proportional to the uncertainty in position of the ions. The brightness is given by $$B = \frac{I}{2\pi\epsilon^2} = \frac{I(K.E.)}{2\pi r^2 kT_i} = \frac{J(K.E.)}{kT_i},$$

which is proportional to the ratio of the current density, J, given by $$\frac{I}{2\pi r^2},$$

to the ion temperature, $T_i$.

Efforts have been made to develop two types of negative ion sources for NPB weapons. Surface plasma sources have been developed which produce very high brightness beams but only for very short pulses and low duty factors, and the multichamber or so called "bucket" type volume sources which operate continuously (CW), but have not yet produced beams of the desired brightness. It is unlikely that either of these sources, in their conventional configurations, will meet the brightness and duty factors required for an advanced NPB weapon system.

To produce a negative ion source that meets or exceeds these desired brightness levels, it was felt that a somewhat radical departure from the current approaches was necessary. Therefore, Roberts, Lavan and Strickland disclosed an electron beam driven negative ion source (U.S. Pat. No. 5,391,962, issued Feb. 21, 1995) which overcomes the limitation these conventional configurations place on themselves.

In any negative ion source, there are mechanism (or reactions) that produce the negative ions and processes that destroy them. The number of negative ions per unit volume is the result of the balance between these constructive and destructive processes. At the extraction aperture, where the useful beam is generated, the extraction itself becomes one of the destructive or loss mechanisms. Thus, the only negative ions that can be extracted to form a negative ion beam are those that are born within one mean free path, on average, from the extraction aperture. This mean free path is determined primarily by the most dominant mechanism that destroys the negative ions. The optimum ion source will therefore consist of independent mechanisms for maximizing the desired conditions near the extraction aperture. The negative ion production process that yields the lowest temperature ions in a cw source must be maximized, while, at the same time, independently minimizing the conditions for the process that most quickly destroys them. The ion sources discussed above do not allow for this independent adjustment of optimum conditions. Again, these conditions need to be produced and maintained only near the extraction aperture.

The lowest temperature negative ions are produced by dissociative attachment of low energy electrons to hydrogen molecules in high vibrational states;

$$e_i^- + H_2^* \rightarrow H_2^- \rightarrow H + H^-$$

where $e_i^-$ is a low energy electron; $H_2^*$ is a vibrationally excited hydrogen molecule, $H^-$ is a negative hydrogen ion and H is a neutral hydrogen atom. (Hydrogen is used here as an example. The vibrationally excited molecule could just as well have been deuterium or tritium. Any other particle that has an affinity for forming negative ions, such as Li, Cl, O, etc., might, at least in principle, also be used.)

The two dominant destruction processes are collisional detachment caused by hot, i.e. fast, electrons:

$$e_f^- + H^- \rightarrow 2\,e^- + H\,,$$

where $e_f^-$ is a fast electron; and associative detachment or recombination which is represented by:

$$H + H^- \rightarrow H_2 + e^-.$$

The equilibrium negative ion concentration is established by a balance between these constructive and destructive processes. However, in some sources, especially when low work function materials like cesium are used, collisions with the walls near the extraction aperture do play a part in the kinetics that produce the negative ions. Another loss mechanism important during extraction, while the $H^-$ ions are being accelerated, is collisional stripping with background hydrogen gas:

$$H^- + H_2 \rightarrow H + H_2 + e_i^-.$$

It is this reaction that limits the $H_2$ gas pressure that can be used in the sources.

In conventional multichamber or "bucket" type negative ion sources, a low voltage (~100 Volts), high current (several hundred amps) dc discharge is used to produce the vibrationally excited $H_2$ molecules. This type of discharge in the first chamber not only produces the desired vibrationally excited $H_2$ molecules, but it also produces many other species such as H, $H^+$, $H_2^+$, and $H_3^+$ which cross the magnetic filter and contribute to the reactions which occur in the extraction region in an undesirable way. Another problem with these discharges is that they always suffer from erosion of the cathodes and filaments that are used to start the discharges. Long filament life is difficult to obtain; therefore, high frequency discharges, which are free of this defect, have also been used. The frequencies used generally range from several hundreds of kilohertz to tens of gigahertz. In this case, the plasma containment vessel can be made from insulators or metals. When metals are used, the vessel can be made in the form of a resonator. In either case, magnetic fields are used to confine the discharge. But, since all of the energy required to produce and maintain the plasma must be supplied by the high frequency power source, the equipment is much more complicated, generally larger, and always more expensive.

The surface plasma sources utilizes a low voltage, high current arc confined to a region near a ceseated converter surface by a strong magnetic field to produce both $H_2$ vibrationally excited molecules and negative ions. In some of these sources, the negative ions produced on the ceseated surface are projected towards the extraction aperture by an electric field applied at the converter surface. In other sources, the negative ions produced on the ceseated cathode are projected towards the low magnetic field region, but not towards the extraction aperture. In both of these sources, the surfaces near the extraction aperture becomes ceseated and additional negative ions are produced there. This makes these sources more complicated and even more difficult to understand than the multichamber cw sources, even when cesium is used in the cw sources.

In all of the above cases, the discharges are self-sustained. This means that the ratio of the electric field (E) to the number of particles per cubic centimeter (n) cannot be optimized simultaneously for both the desired discharge operation and the production of $H^-$ ions. The operation of the arc or discharge is critically dependent on this ratio (E/n). If E/n is too low, the discharge cannot be maintained, and near the threshold value of E/n, for self-sustained operation, the discharge tends to be unstable and noisy. The population of the $H_2$ molecules in the high vibrationally exited states is even more sensitive to E/n. The range of value of E/n for which the arc operates satisfactorily is far from the optimum value for the excitation of $H_2$ to high vibrational states by collisions with the electrons in the discharge. Therefore, in these sources, the best operating conditions are established by a trade-off between two conflicting requirements on the arc voltage and the $H_2$ pressure or flow rate. An ideal source would allow for these two requirements on E/n to be optimized independently. Of course, in this case, the discharge cannot be self-sustained and it must be sustained by some other means.

This fact was recognized by Roberts, et al, when they felt that a radical departure from the above approaches was necessary. Therefore, they disclosed "An Electron Beam Driven Negative Ion Source", (U.S. Pat. No. 5,391,692, cited hereinabove), wherein an electron beam produced in one chamber is used to sustain in another chamber a discharge whose conditions are independently adjusted for optimum production of vibrationally excited hydrogen molecules and in yet another chamber there is an independently controlled source of low energy electrons in a region near an extraction aperture. In this manner, the optimum conditions for creation of $H^-$ ions by dissociative attachment are produced so that the current and brightness of the $H^-$ beam may be maximized. However, this device loses sight of the lesson learned from the previous efforts, and does not lend itself to utilization of the many nuances that have been developed. The Roberts, et.al. device uses a high voltage electron gun and a fragile thin foil. It does not make use of magnets to confine the discharge plasma. It is large, very expensive, and unnecessarily complex , and it uses relatively large amounts of $H_2$ gas, which, along with the high voltages, can cause safety problems that either limit its usefulness or cause additional expensive complexities, and it does not provide for automatic operation.

Therefore, it is an object of this invention to provide an automatically controlled negative ion source which uses as much of the current state-of-the-art technology as possible, but yet allows independent control of E/n for the optimum production of vibrationally excited molecules. Thus, in accordance with this invention, conditions are created near the extraction aperture for the extraction of maximum low temperature $H^-$ ions and the production of very bright negative ion beams. To accomplish this, a direct current (dc) discharge that does not run self-sustained is required.

SUMMARY OF THE INVENTION

The objective of this invention is to provide an automatically controlled negative ion source wherein a low power high frequency (HF) discharge is used to sustain a low voltage dc discharge. Most of the energy is supplied to the plasma by the dc discharge. The voltage of the dc discharge and the gas pressure can be independently adjusted so that the value of E/n is optimum for the production of vibrationally excited hydrogen molecules. This discharge is magnetically confined and is separated from the region near the extraction aperture by a filter field in a conventional manner, thus producing the optimum conditions for the production of $H^-$ ions due to disassociative attachment in a region near the extraction aperture. The aperture is also conventional and may include nuances such as: collars to suppress the extraction of electrons, low work function washers to increase the production of $H^-$ from surface reactions, thermionic emitters to increase the density of low energy electrons, cesium dispensers, bias voltages, etc. The automatic control is obtained in a closed loop system that uses the measured value of the output $H^-$ current as a feedback signal. This signal is maximized by varying the outputs of the HF power supply, the dc power supply and the gas pressure. The gas flow rate through the discharge is maintained such that the $H_2$ gas thermalizes in the molecular vibrational mode, but not between the vibrational mode and the translational mode.

DETAILED DESCRIPTION OF THE INVENTION

Figure 1:
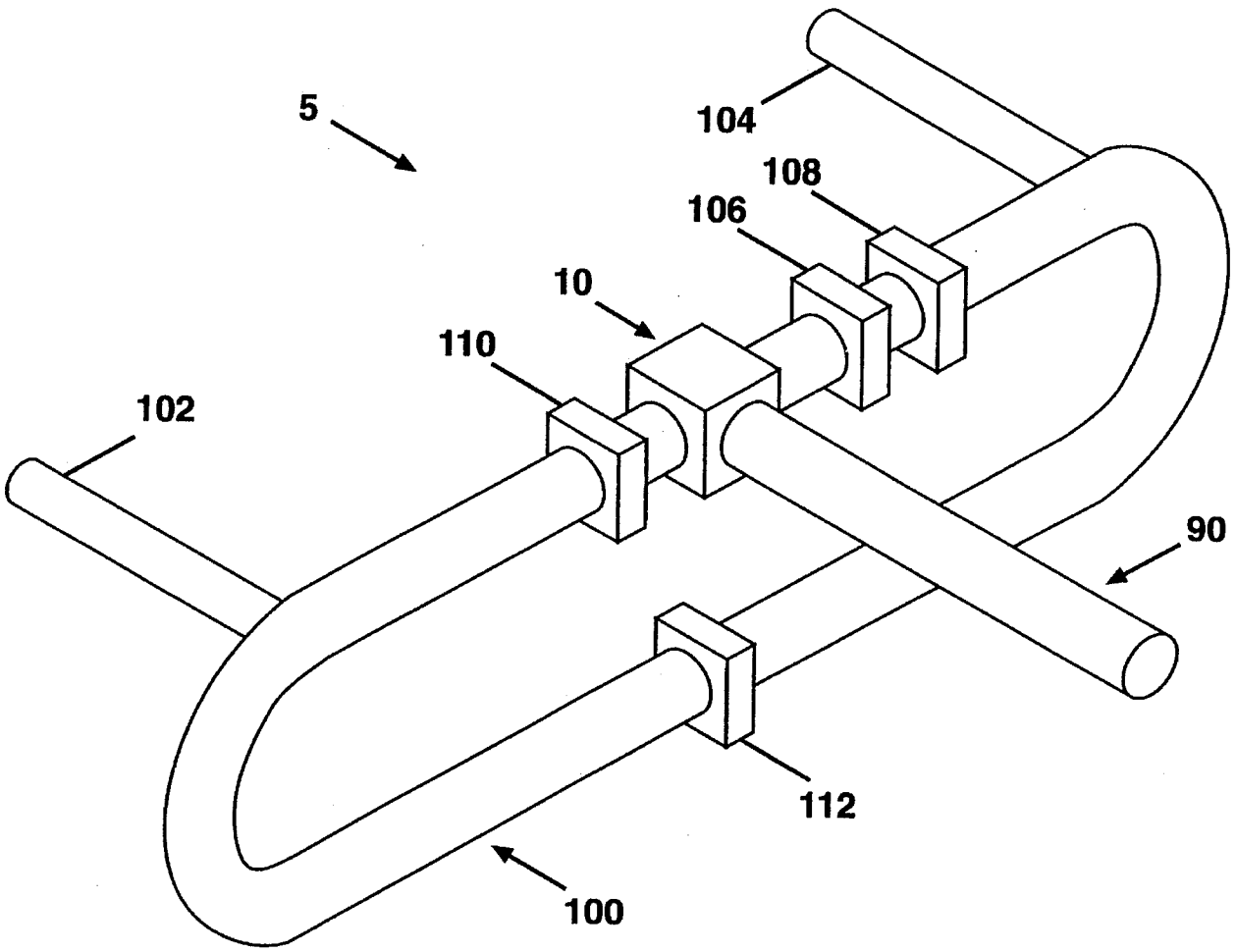
FIG. 1 is a schematic illustration of the HF sustained, dc discharge driven negative ion source apparatus shown without the automatic control system.
Figure 2:
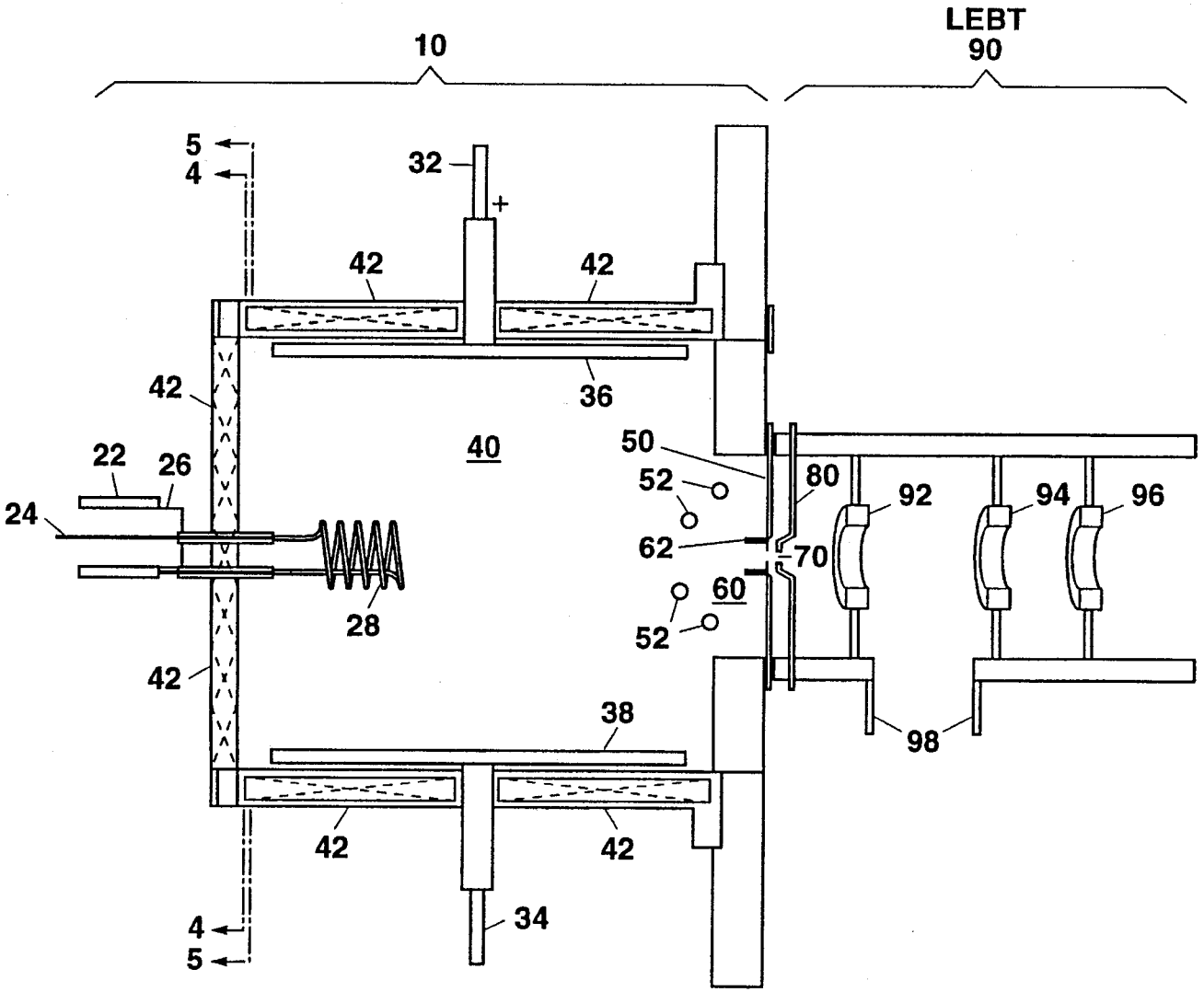
FIG. 2 is a schematic cross-sectional negative ion source and the low energy beam transport system (LEBT).
Figure 5:
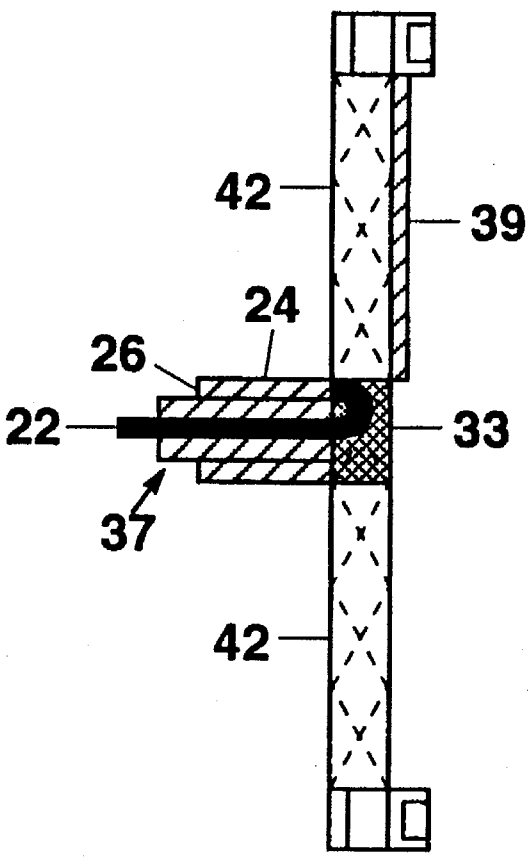
FIG. 5 is an illustration of the use of a transparent window and a coax transmission line instead of the induction coil RF antenna.
Figure 6:
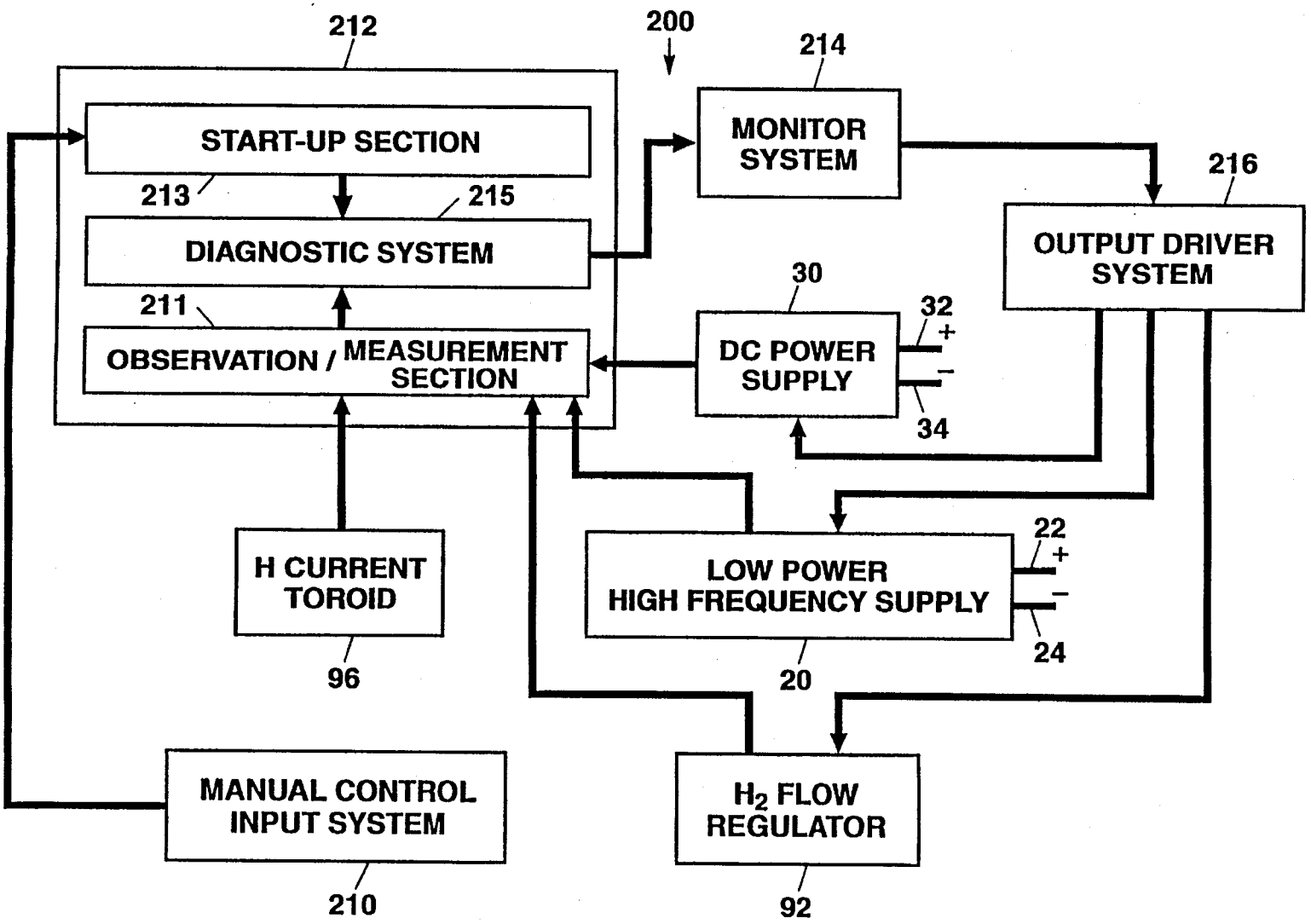
FIG. 6 is a block diagram of the closed loop automatic control system for the HF sustained, dc discharge driven negative ion source apparatus.

Attention is now directed to FIGS. 1–6 which show the details of the high frequency (HF) sustained, dc discharge driven negative ion source apparatus incorporating the invention. This apparatus 5, as indicated in FIG. 1, consists of a negative ion source 10, a low energy beam transport (LEBT) system 90,, a gas flow system 100, and an automatic control system 200 which is shown in FIG. 6. The negative ion source 10 and the LEBT 90 are illustrated in FIG. 2. This view is shown in a plane that passes through the center line of the LEBT 90 and is perpendicular to the center line of the gas flow system 100. The ion source 10 consists of a low power high frequency (HF) antenna 28, dc discharge electrodes 36 and 38, a magnetically confined discharge chamber 40 produced by the permanent magnets 42 and the filter field magnets 52, a negative ion production chamber 60 defined by the magnetic fields produced by the magnets 52 and the plasma electrode 50, and an extraction region defined by the plasma electrode 50 and the accelerating or extracting electrode 80. The chamber 60 also contains a collar 62 to help suppress the extraction of electrons whose mean free paths are much greater (4 times) than those of the negative ions. The negative ions are extracted through the apertures 70 in the electrodes 50 and 80. The permanent magnets 42 and filter magnets 52 are contained in copper tubes which are water cooled. The discharge is in $H_2$ gas which flows through the discharge chamber 40. The gas flow system 100 which moves the $H_2$ through chamber 40 is shown as a closed loop system in FIG. 3. This view of the gas flow system is shown in a plane that passes through the center line of the gas flow system and is perpendicular to the center line of the LEBT. This gas flow system 100 is explained in more detail hereinbelow. The low power HF discharge is started by the use of a thermionic filament (not shown) as is standard practice. The automatic control system 200 is augumented by a manual control input system 210 and a start up section 13.

Figure 3:
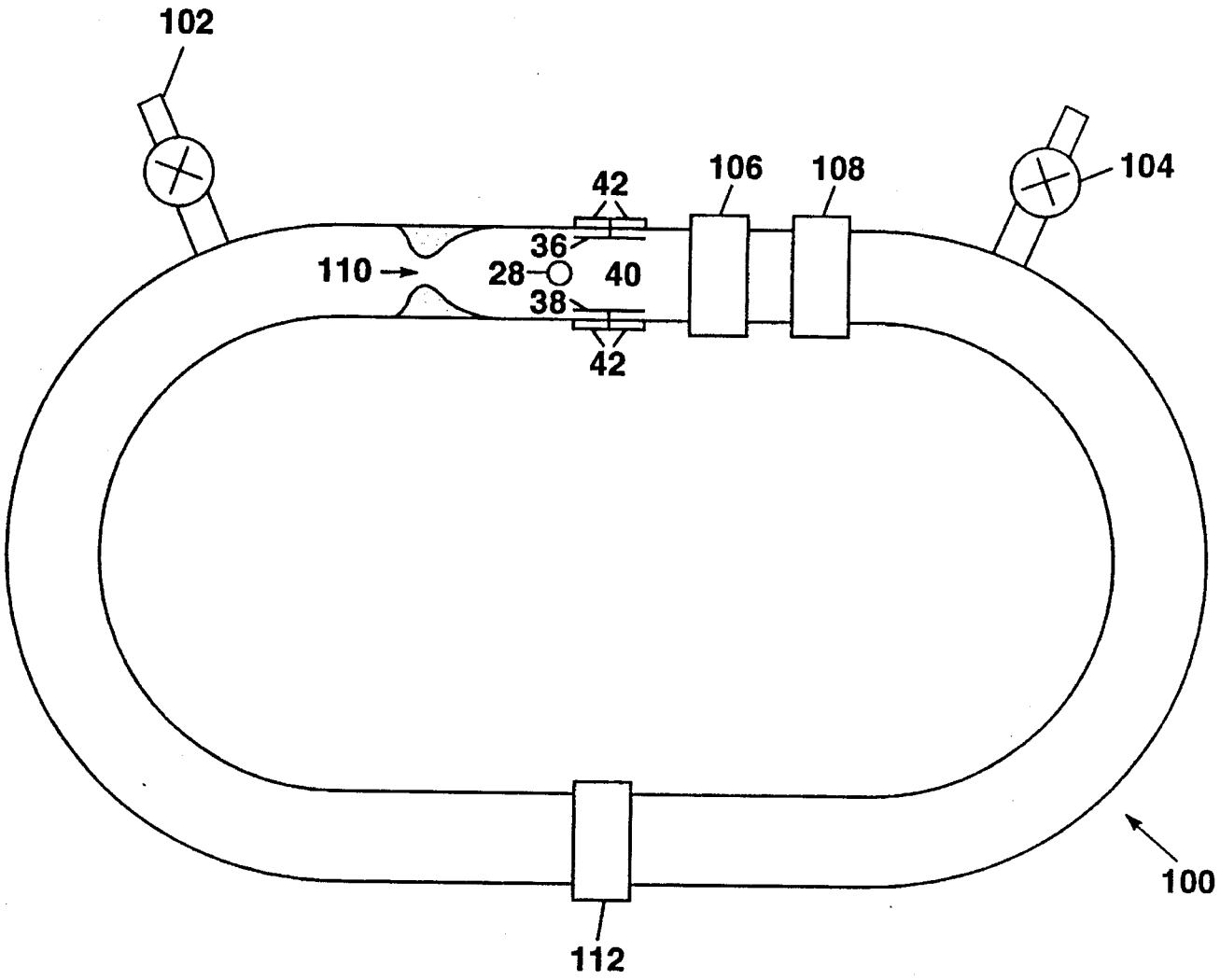
FIG. 3 is a schematic cross-sectional view of the negative ion source and its closed loop gas flow system.
Figure 4:
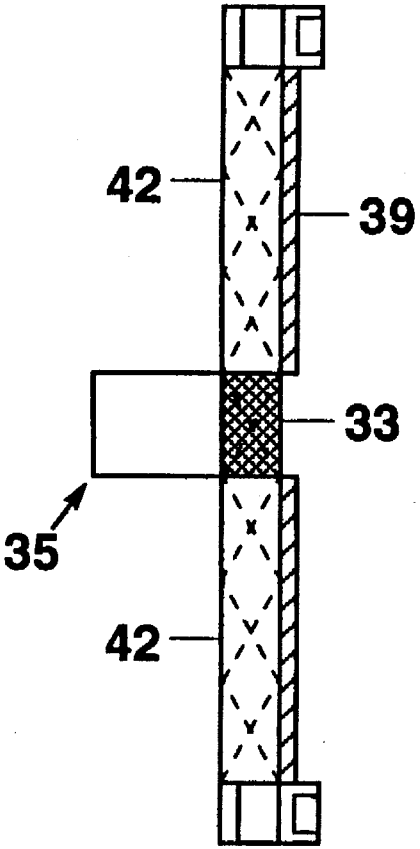
FIG. 4 is an illustration of the use of a transparent window and a waveguide transmission line to replace the induction coil RF antenna.

The HF power could also be admitted to chamber 40 through an HF transparent window 33 located, for example, where the HF antenna leads are located. In this case, a waveguide 35 or coax 37 transmission line is used to bring the HF power up to the window, as shown in FIG. 4 and FIG. 5. FIG. 4 is a view along line 4—4 of FIG. 2, and FIG. 5 is a view along line 5—5 of FIG. 2, which depict respectively, the location of the HF transparent window where the leads to the HF antenna are located as shown in FIG. 3. A HF transparent window can be constructed of glass fibers, a plastic such as polymethacrylate, or any standard HF transparent window materials known in the art for this designated use. Such a window would be used when corrosive gases like $O_2$, or $Cl_2$ are used to produce $O^-$ or $Cl^-$ion beams. These windows could also be used with $H_2$, $D_2$, or $T_2$ gases, but in the preferred embodiment, the HF antenna is utilized. Many of the features of this source, like the arrangement of the permanent magnets, the filter magnets, the extraction electrode, etc., are standard in the state-of-the-art, and it is assumed that good ion source engineering practices have been used in their design.

The low power HF supply 20 with inputs from 216 and outputs to 212 is shown in FIG. 6. The output leads 22 and 24 of this power supply are connected to the leads 22 and 24 of FIGS. 2 and 5, also an insulator 26 separates these leads. FIG. 4 and FIG. 5 depict a typical installation for a waveguide and a coax transmission line, repectively, for admitting HF power to chamber 40. The dc power supply 30 (with inputs from 216 and outputs to 212), which supplies the energy that produces the vibrationally excited $H_2$ molecules is shown schematically in FIG. 6. The leads 32 and 34 are connected to the leads 32 and 34 of FIG. 2. If the accelerating electrode 80 is run at ground potential, as is usually the case, then these two power supplies are contained in a high voltage deck that is at the same potential drop as that between the plasma electrode 50 and the accelerating electrode 80. This potential depends on the application of the ion source, but it is generally of the order of a few 10's of kilovolt negative with respect to ground. The connections as shown in FIGS. 2, 4, 5, and 6 help to define the electric field which allows for a more spatially uniform value of E/n. This preferred configuration of the electrodes 36 and 38 also allows all of the walls of chamber 40 to be made of a corrosion resistant insulator material 39 (as shown in FIG. 4 and FIG. 5 for a typical wall construction of chamber 40) instead of a metal when corrosive gasses are used.

To operate this ion source apparatus all parameters (the output of the HF supply, the output of the dc supply, the mass flow rate of $H_2$, and the voltage on the extraction electrode 80) are set at their theoretical values or at values obtained from previous operations of the source. Manual control input system 210 is used to input these values to the observation/measurements section 211 as shown in FIG. 6. The $H^-$ current is measured while the output of the HF power supply is increased and decreased in small steps (dithered) until a maximum in the output $H^-$ current is obtained. Then, the mass flow rate of $H_2$ and the output of the dc power supply are also dithered until a new maximum current is obtained. This process is repeated, if necessary, until the output current is at a maximum and is steady. At this point the manual control system is cut off and the closed loop control system 200 maintains the operation of the total system in a cruise control mode. In the event that the output $H^-$ current decreases for some reasons, the parameter or parameters which changed to cause the decrease are automatically reset. If the $H^-$ current drops out (goes to zero) due to an intermittent spark between the plasma electrode and the extraction electrode, then the voltage to the extraction electrode is turned off and slowly brought back up. After the voltage on 80 has been reestablished, the output current optimization process is repeated if necessary. When operation at some $H^-$ current level less than maximum is desired, the control system can also be set to produce and maintain the desired current value. In this case, it is generally better to reduce output of the dc power supply and the gas flow rate until the desired current level is reached. Then, the automatic control system 200 is allowed to maintain this value.

The magnetic filter field produced by the magnets 52 can also be obtained by proper arrangement of the magnets 42 so that the magnets 52 are not needed, and many of these arrangements can be made to work. However, the arrangement of apparatus 10 with the extraction and acceleration system shown in FIG. 2 is preferred. Further description of FIG. 2 illustrates the extraction and acceleration functions. After the negative ion beam has been extracted and accelerated to the potential of electrode 80, it is transported and focused by a low energy beam transport (LEBT) section 90 into a radio frequency electric quadrupole accelerator (RFQ), or some other type of accelerator, for high energy particle experiments or for fusion energy application. The LEBT 90 is a low pressure section that contains the optics 92 and 94 that are required to transport and focus the negative ion beam and a current toroid 96 to measure the $H^-$ current level. These optics may be either magnetic, electromagnetic, or electrostatic. The port 98 illustrates a connection to the vacuum pumping station which maintains the desired pressure in 90. The gas that is pumped from 90 enters through the extraction aperture 70. In some applications, additional heavy gasses such as xenon may be added to 90 through a port not shown. This heavy gas is used to help reduce the space charge forces of high current beams through a process known in the art as ion focusing. When the space charge has been neutralized, the negative ion beam is more easily transported and focused. That is, the requirements on the optics 92 and 94 are greatly relaxed.

In operation, $H_2$ gas in the closed loop system 100 of FIG. 1 and FIG. 3 is admitted to the chamber 40 through port 102. The pressure in 40 is maintained in the range of a few Torr. The HF power supply 20 is turned on and a discharge is started in and about antenna 28. This discharge creates some conductivity in the medium between electrodes 36 and 38. The dc power supply 30 is now turned on and a dc discharge is created between electrodes 36 and 38. This discharge is sustained by the conductivity created by the HF discharge. That is, if the HF power supply 20 is turned off, the dc discharge will decay and no current will flow between electrodes 36 and 38 even though the dc power supply is still on. The conductivity is increased or decreased by controlling the output of the HF power supply. For a given setting of the controls on the dc power supply, this will increase or decrease the current that flows between electrodes 36 and 38. The pressure in 40 is varied by changing the mass flow rate of $H_2$ through 40. The closed loop gas flow system 100 that moves the $H_2$ through chamber 40 consists of a pump 106, a heat exchanger 108, a diagnostic box 112 for measuring the temperature and the pressure of the $H_2$ gas, a constriction or nozzle 110, the $H_2$ gas inlet port 102, and $H_2$ outlet port 104. The pressure in 40 is varied by adding $H_2$ gas through the inlet port 102 or extracting $H_2$ gas through the outlet port 104. A small, but equal, amount of gas is continuously added through 102 and extracted through 104. By independently varying this pressure and the output of the dc power supply, E/n between electrodes 36 and 38 can be adjusted. The value of E/n is adjusted so that the energy gained by an electron which is accelerated by the electric field over one mean free path is equal to the optimum energy for collisional excitation of an $H_2$ molecule to a higher vibrational state. In this manner, the characteristics of the discharge and the conditions for producing vibrationally excited $H_2$ molecules are independently optimized. A negative ion beam is extracted when a voltage of a few tens of kilovolts is applied to the extraction electrode 80. The extracted current is measured and its value is optimized by independently varying the outputs of the HF power supply, the dc power supply and the mass flow rate of $H_2$. As described by T. H. Maimam, (Phys. Rev. Letters 4, 564, 1960) the output voltage of the dc power supply can be set so as to theoretically optimize production of vibrationally excited $H_2$ molecules for a given pressure setting. However, the losses due to stripping reactions that take place in the extraction chamber 60 increases with pressure ,are design dependent, and cannot be calculated. Therefore, the above optimization process is necessary. That is, the vibrationally excited $H_2$ molecules can be increased by increasing the output of the HF power supply or by increasing both the output of the dc power supply and the mass flow rate of $H_2$ so that E/n remains optimized. The production of $H^-$ ions increases as the concentration of the $H_2$ vibrationally excited molecules increases. This tends to increase the extracted negative ion current; but, as the gas pressure increases, the losses due to stripping reactions that take place in the extraction chamber 60 also increases. The pressure between 50 and 80 must be maintained low enough so that the distance between 50 and 80 is much less than one mean free path for this particular loss mechanism. Therefore, the maximum $H^-$ current that can be extracted is a trade-off or balance between the increase in $H^-$ production due to increased concentration of vibrationally excited $H_2$ molecules and the loss of $H^-$ due to stripping in the extraction and initial acceleration processes. However, using the measured value of the output $H^-$ current as a feedback signal, a closed loop control system 200 (FIG. 6) is set up which allows this source to operate autonomously. The automatic control is obtained in a closed loop system that uses the measured value from current toroid 96 of the output $H^-$ current as a feedback signal. This signal is maximized by varying the outputs of the HF power supply 20, the dc power supply 30 and the gas pressure 92. The gas flow rate through the discharge is maintained such that the $H_2$ gas thermalizes in the molecular vibrational mode, but not between the vibrational mode and the translational mode. The autonomous ion source described above consists of two major parts: the ion source 10 with its gas flow system of FIG. 1 and its control system 200 of FIG. 6. The controls consist of a diagnostic section 212, which includes a start up-section 211, and a diagnostic system 215, a monitor or computer 214, and an output driver system 216. The diagnostic section consists of the measurement devices located on the power supplies 20 and 30, the gas flow regulator 92 and the $H^-$ current toroid 96, plus a computer. A monitor is a device for controlling a process or activity, and the computer performs both the diagnosis and the monitoring function. The computer changes the outputs of the power supplies and the gas flow regulator in the manner described above.

The above description is for continuous operation of the source. For applications that require a pulsed $H^-$ beam, this source may be operated in a pulsed mode. To accomplish this, the dc voltage to electrodes 36 and 38 may be pulsed or the voltage to electrode 80 may be pulsed. In either case, a different power supply and a pulse forming network may be desired. If zero $H^-$ current between pulses is required, it would be better to pulse the voltage on the extraction electrode 80. With a constant voltage on this electrode, the HF discharge produced by the antenna 28 would cause a low value of $H^-$ current to be extracted continuously. The HF power supply could also be pulsed if desired, but this would produce a less well defined pulse and may make control of the output $H^-$ current more difficult. The conditions for maximum $H^-$ output in the pulsed mode can be different than for steady state operation, especially when the pulse width is short. The control system works the same for pulsed operation except that adjustments (dithering) occurs between pulses.

The most important features of the ion source disclosed hereinabove are the use of the relatively low level HF discharge to sustain a dc discharge in an arrangement that allows for independent production of the conductivity of the dc discharge and the value of the electric field and particle density ratio (E/n) that exists in the dc discharge. Still another important feature of this invention is the closed loop automatic control system which receives and analyzes diagnostic information and outputs to the system drivers which results in the ability to automatically optimize and control both the conductivity and E/n of the dc discharge. Thus, the ion source current is maximized and the emittance is maximized thereby maximizing the brightness.

We claim:

1. A high frequency sustained, direct current discharge driven negative ion source apparatus with automatic control system comprising:

(i) a magnetically contained discharge chamber positioned within a gas circulating flow system which provides a source of gas for producing vibrationally excited gas molecules within said magnetically contained discharge chamber;

(ii) a high frequency power supply for providing a discharge for creating some conductivity in a medium between a pair of discharge electrodes, said high frequency power supply having an output which can be increased to provide an increase in said vibrationally excited gas molecules produced;

(iii) a pair of direct current discharge electrodes which are provided with a direct current power supply and which are positioned within a magnetically contained discharge chamber, said direct current discharge providing voltage which can be independently adjusted along with gas pressure of said gas circulating system so that a value of E/n is optimum for the production of said vibrationally excited gas molecules, said vibrationally excited gas molecules being vibrationally excited hydrogen molecules when said source of gas is hydrogen;

(iv) a gas circulating flow system which provides a source of gas for circulating through said magnetically contained discharge chamber wherein said vibrationally excited gas molecules are produced, said gas circulating flow system comprising a heat exchanger, a gas pump, and a constriction or nozzle within said gas circulating flow system, said gas circulating flow system further comprising a circulating gas inlet port, a circulating gas outlet port, a diagnostic box for measuring the temperature and pressure of gas circulating through said gas circulating flow system, said gas circulating flow system providing gas with pressure which can be independently adjusted along with said voltage of said direct current discharge so that a value of E/n is optimum for the production of said vibrationally excited hydrogen molecules;

(v) an extraction chamber for receiving the discharge of gas flow from said magnetically contained discharge chamber, said extraction chamber defined by a magnetic filter member and a partition member positioned between said extraction chamber and an accelerating and extraction electrode, said accelerating electrode supplied with kilovolts negative charge with respect to ground when a negative ion beam is to be extracted by said accelerating and extraction electrode;

(vi) a magnetic filter member positioned in discharge gas flow from said magnetically contained discharge chamber;

(vii) an extraction aperture installed in said partition member and having a surrounding collar member which helps to suppress the extracting of electrons whose mean free paths are much greater than those negative ions which are to be extracted and accelerated through an aperture of an accelerating and extraction electrode to form an ion beam;

(viii) an accelerating and extraction electrode having an aperture through which a negative ion beam is received from said extraction aperture, transported, and focused by a low energy beam transport section into a radio frequency electric quadruple accelerator for high energy particle experiments or for fusion energy application;

(ix) said low energy beam transport section installed within a low pressure gas circulating flow system for receiving, transporting, and focusing a negative ion beam, said low energy beam transport section provided with optics to transport and focus the negative ion and a current toroid to measure $H^-$ current level; and (x) a closed loop control system for operating said high frequency sustained and direct current discharge driven negative ion source autonomously, said closed loop control system comprising:

(a) a diagnostic section comprising: a diagnostic system/start-up section and an observation/measurement section within said diagnostic section, said diagnostic system/start up section and said observation/measurement section employed to set theoretical values or values from previous operations of said high frequency sustained, direct current discharge driven negative ion source apparatus, said diagnostic system providing outputs to a monitor system based on input from direct current power supply, gas flow regulator to maintain gas pressure to achieve a desired gas mass flow rate, low power high frequency power supply, $H^-$ current toroid, and manual control input system;

(b) a monitor system having means for receiving outputs from said diagnostic section and processing said outputs to an outputs drivers system; and (c) an output drivers system for providing revised output to said direct current power supply, said gas flow regulator, and said low power high frequency supply based on input received from said diagnostic system of a measured output value of $H^-$ current level as a feedback signal which is maximized by varying the outputs of said low power high frequency power supply, direct current power supply, and said gas pressure to achieve a desired gas mass flow rate through said discharge such that said vibrationally excited hydrogen gas molecules thermalize in the molecular vibrational mode to achieve continuous autonomous operation of said high frequency sustained and direct current discharge driven negative ion source apparatus.

2. A high frequency sustained, direct current discharge driven negative ion source apparatus with automatic control system as defined in claim 1 wherein said high frequency power supply is connected to a low power high frequency antenna for providing a discharge for creating some conductivity in a medium between a pair of discharge electrodes and wherein said pair of direct current discharge electrodes are positioned in a spaced apart relationship to the magnets employed in said magnetically contained discharge chamber which is provided with resistant insulator material between said direct discharge electrodes and said magnets, and wherein said source of gas for circulating through said magnetically contained discharge chamber is selected from the group consisting of hydrogen, deuterium, and tritium.

3. The high frequency sustained, direct current discharge driven negative ion source apparatus with automatic control system as defined in claim 1 wherein said high frequency power supply is admitted through a transparent window from a waveguide or coax transmission line used to bring the high frequency power up to said transparent window, said high frequency power proving means for creating some conductivity in a medium between a pair of discharge electrodes and wherein said pair of direct current discharge electrodes are positioned in a spaced apart relationship to the magnets of said magnetically contained discharge chamber which is provided with resistant insulator material between said direct current discharge electrodes and said magnets, and wherein said source of gas for circulating through said magnetically contained discharge chamber is selected from the group consisting of hydrogen, deuterium, tritium, oxygen, and chlorine.

* * * * *